US006584624B2

(12) United States Patent
Horwood et al.

(10) Patent No.: US 6,584,624 B2
(45) Date of Patent: Jul. 1, 2003

(54) PORTABLE SPA

(76) Inventors: Tim P. Horwood, 14733 Willow Creek La., Chino Hills, CA (US) 91709; Keith W. Lovell, 8 Navajo Trail La., Pomona, CA (US) 91766; John E. Pope, 14300 Clinton St. #4, Garden Grove, CA (US) 92843

( * ) Notice: Subject to any disclaimer, the term of this patent is extended or adjusted under 35 U.S.C. 154(b) by 0 days.

(21) Appl. No.: 10/137,929

(22) Filed: May 2, 2002

(65) Prior Publication Data

US 2002/0129444 A1 Sep. 19, 2002

Related U.S. Application Data

(63) Continuation of application No. 09/491,361, filed on Jan. 26, 2000, now abandoned.

(51) Int. Cl.[7] ..... A47K 3/00
(52) U.S. Cl. ..... 4/541.1; 4/506
(58) Field of Search ..... 4/506, 541.1, 541.5

(56) References Cited

U.S. PATENT DOCUMENTS

| | | | |
|---|---|---|---|
| 3,555,575 | A | 1/1971 | Schwartz et al. |
| 4,019,210 | A | 4/1977 | Patterson et al. |
| 4,110,852 | A | 9/1978 | Kline |
| 4,142,337 | A | 3/1979 | Holcomb |
| 4,233,694 | A | 11/1980 | Janosko et al. |
| 4,661,247 | A | 4/1987 | Weir et al. |
| 5,056,167 | A | 10/1991 | Cholley |
| 5,199,116 | A | 4/1993 | Fischer |
| 5,224,224 | A | 7/1993 | Hintz et al. |
| 5,236,581 | A | 8/1993 | Perry |

OTHER PUBLICATIONS

The Hot Spring Spa brochure from Watkins Manufacturing Corp. (1982).

The Life Style brochure from Discovery Corporation (date unknown).

HotSpring Portable Spas brochure from HotSpring Portable Spas (1993).

*Primary Examiner*—Charles E. Phillips
(74) *Attorney, Agent, or Firm*—Knobbe, Martens, Olson & Bear, LLP

(57) ABSTRACT

A portable spa comprises a reservoir for holding water and an outer wall spaced outwardly from the reservoir. The spa includes an equipment bay located between the reservoir and the outer wall that is accessible from an opening at a top portion of the spa. A cover over the opening to the equipment bay is removable from the top portion of the spa to permit access to the equipment bay. The equipment bay contains substantially all of the equipment necessary for operation of the spa and can be conveniently accessed free of any obstructions around the side of the spa. The spa can be installed either above ground in the manner of a portable spa, or it can be installed directly in the ground in the manner of a permanent in-ground spa. Reinforcing means comprising an internal support framework supports the spa against the lateral external forces generated as a result of in-ground installation.

8 Claims, 5 Drawing Sheets

FIG. 5
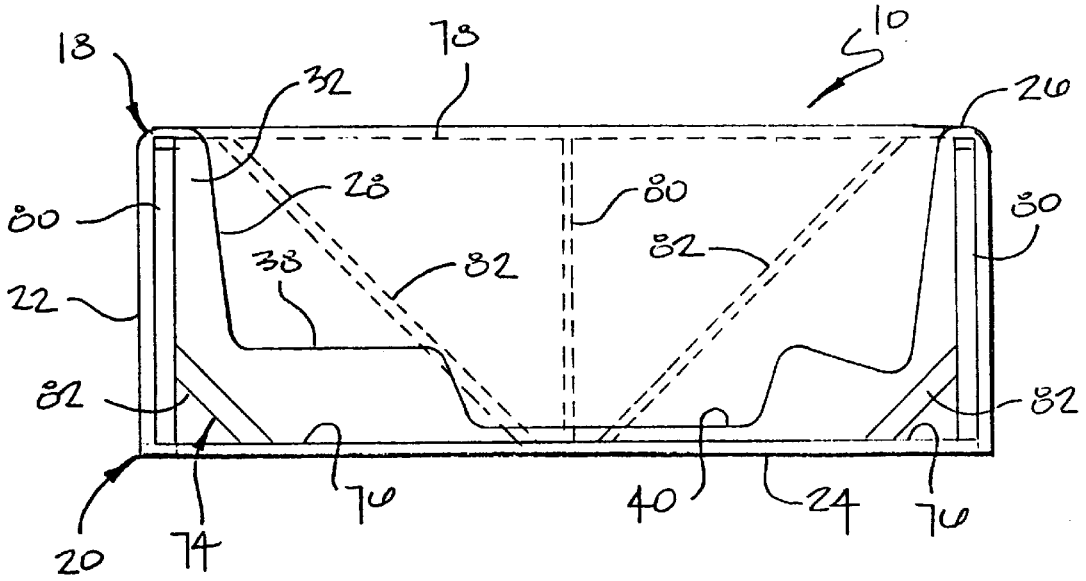
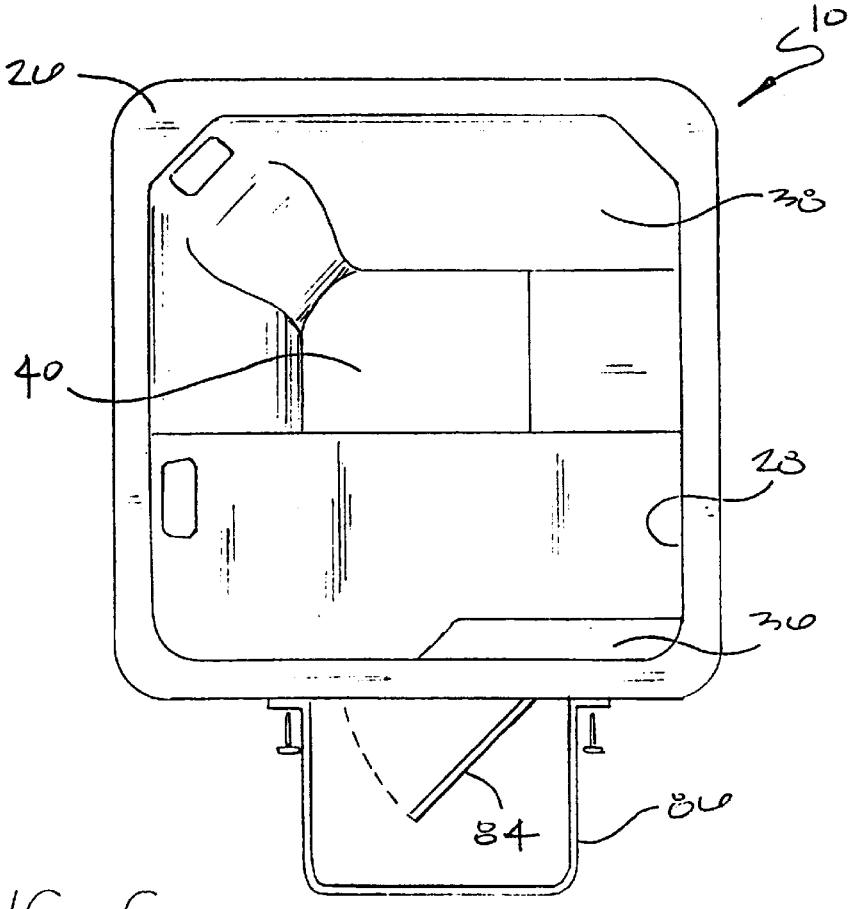
FIG. 6

PORTABLE SPA

RELATED APPLICATION

This is a continuation of application Ser. No. 09/491,361, filed Jan. 26, 2000 abandoned.

BACKGROUND OF THE INVENTION

1. Field of the Invention

The present invention relates to portable spas and, more particularly, to a spa which may be installed either in the ground or above the ground without hindering access to the technical equipment necessary for operation of the spa.

2. Description of the Related Art

Traditionally, there have been two distinct types of spas, permanent in-ground spas and portable spas that can be installed either above or below the ground. In-ground spas consist essentially of a shell installed in the ground that includes hydro-jets around its perimeter designed to circulate heated water within the spa. Plumbing to the hydro-jets must be installed underground and routed to the spa from a remote maintenance area which houses the necessary technical equipment, such as the pumps, heaters, filters and valves. While in-ground spas are generally considered more aesthetically pleasing than portable spas, they are also relative expensive and time consuming to install and are virtually impossible to remove and subsequently install at a different location.

Portable spas are usually stand-alone upright structures in which the water reservoir and all of the plumbing and technical equipment are within a single self-contained unit. These spas are advantageous in that they are easily installed above the ground without excavating the ground, and they can be moved to another location with little or no damage to the spa itself. Since portable spas are typically about three to four feet tall, a deck, or at least a set of stairs, is often built around the top of the spa to enhance the spa's appearance as well as provide easier accessibility for the user.

In some cases, owners of portable spas will install the spa below ground level to simulate the appearance of a permanent in-ground spa. However, the current industry rules governing underground installation of portable spas requires excavation of a hole larger than the spa itself, and the construction of a retaining wall or other suitable barrier to keep the pressure of the surrounding earth off the side walls of the spa. This undesirably adds to the installation expense and requires construction of a deck or the like to cover the gap between the top of the spa and the retaining wall.

Portable spas have traditionally provided access to the technical equipment (i.e., pumps, heater, etc.) through an equipment access door in one of the side walls of the spa. If the spa is installed above the ground, with a deck built around the spa, the deck must include a door or hole in one side to reach the spa's equipment access door. This has the disadvantage that it detracts from the appearance of the deck while increasing the expense. It also may be inconvenient to maintain or repair the spa's equipment, since one must crawl under the deck.

Similar disadvantages arise when a portable spa is installed below ground level. In these cases, the retaining wall in the excavated hole must be considerably wider than the spa itself to provide room to reach the spa's equipment access door at the side of the spa. Not only is the cover for this hole (in the deck between the spa and the retaining wall) usually unattractive, but the hole itself poses a potential safety hazard.

Accordingly, there has existed a definite need for a universal portable spa than can be installed either above the ground or below the ground, while simultaneously providing access to the technical equipment, and without sacrificing appearance and safety. There has also existed a need for a portable spa that is easier to install, repair and maintain. The present invention satisfies these needs and provides further related advantages.

SUMMARY OF THE INVENTION

The present invention provides a spa for use in heating and circulating water in the form of a self-contained unit having all of the equipment necessary for operation of the spa. The spa is capable of either above-ground installation in the manner of a portable spa or direct in-ground installation in the manner of a permanently installed spa. In either case, regardless of the manner of installation, access to the equipment for operation of the spa is convenient and not hindered in any way.

The spa comprises a reservoir for holding water and an outer wall surrounding the reservoir. An equipment bay containing all of the equipment necessary for operation of the spa is located in and accessible from an opening of the top portion of the spa between the outer wall and the reservoir. A cover over the opening to the equipment bay is opened from the top portion of the spa to permit access to all of the equipment in the equipment bay. Thus, access to the equipment is provided in a safe and convenient fashion, free of any obstructions that may be around the outer wall at the side of the spa.

In one aspect of the invention, the opening to the equipment bay is provided in a substantially horizontal coping that joins the reservoir to the outer wall. When the cover is closed, it may be sealed to the opening in a substantially water-tight manner so that the equipment in the equipment bay, such as a heater, pump and related control equipment, can be free of water intrusion. The spa also includes a water filter in a filtration compartment normally flooded with water from the reservoir, and filter cartridges for filtering impurities from the water. The filtration compartment is normally separated from the equipment which may be housed in a separate equipment compartment, and the two compartments need not be covered by the same cover. However, for convenience, the two compartments may be located side-by-side and share a common cover.

In another aspect of the invention, reinforcing means are provided between the outer wall and the reservoir for supporting the outer wall against deformation from external forces. When the spa is installed below ground level, the reinforcing means withstands the external forces from excavated ground that is in direct contact with, and therefore applies pressure directly against, the outer wall. The reinforcing means may comprise a plurality of internal support elements, it may comprise a dense foam material, or it may comprise a combination of both.

In one embodiment of the reinforcing means, the support elements comprise a framework including a plurality of horizontal bottom support elements, a plurality of horizontal top support elements, and a plurality of vertical support elements that connect the bottom support elements to the top support elements. A plurality of bracing elements connected at an angle between the vertical support elements and the horizontal bottom support elements assist in supporting the framework and, thus, the outer wall against deformation from lateral external forces. This framework may be comprised of pressure-treated wood or other suitable materials.

In an alternative form of the invention, the opening to the equipment bay may be provided in the outer wall at a side of the spa. A shield is provided over the opening that can, like the reinforcing means, withstand deformation from external forces, for example, from the ground surrounding the spa. The shield is spaced from the opening such that the spa can be installed below ground level, and the equipment bay can be accessed by removing the cover over the opening.

The spa of the present invention is extremely versatile, as it can be installed either above ground or below ground level, while still providing a means to access the equipment necessary to operate the spa. Access to the equipment is both convenient and safe, and the overall appearance of the spa and its surrounding environment can be made to be as aesthetically pleasing as possible.

For example, if the spa is installed above the ground, a wood deck may be constructed around the spa, without requiring a side access door or a top access door in the deck, since access to the equipment bay can be reached from the top of the spa. Similarly, the spa can be installed directly in the ground and the excavated earth can be applied directly to the side of the spa, to simulate the appearance of a permanent in ground spa. No retaining walls or other type of barriers are needed. Thus, the resulting spa has enhanced utility, as it may be portable or permanently installed at the option of the user. It is also relatively easy and inexpensive to install, repair and maintain, without any underground pipes and attendant problems from leaks or the like.

Other features and advantages of the present invention will become apparent from the following description of the invention, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 5 is a side schematic view of the spa in which an internal support structure is illustrated in dashed lines.

FIG. 6 is a top plan view of a spa showing an alternative embodiment of the invention.

DETAILED DESCRIPTION OF THE PREFERRED EMBODIMENTS

Figure 1:
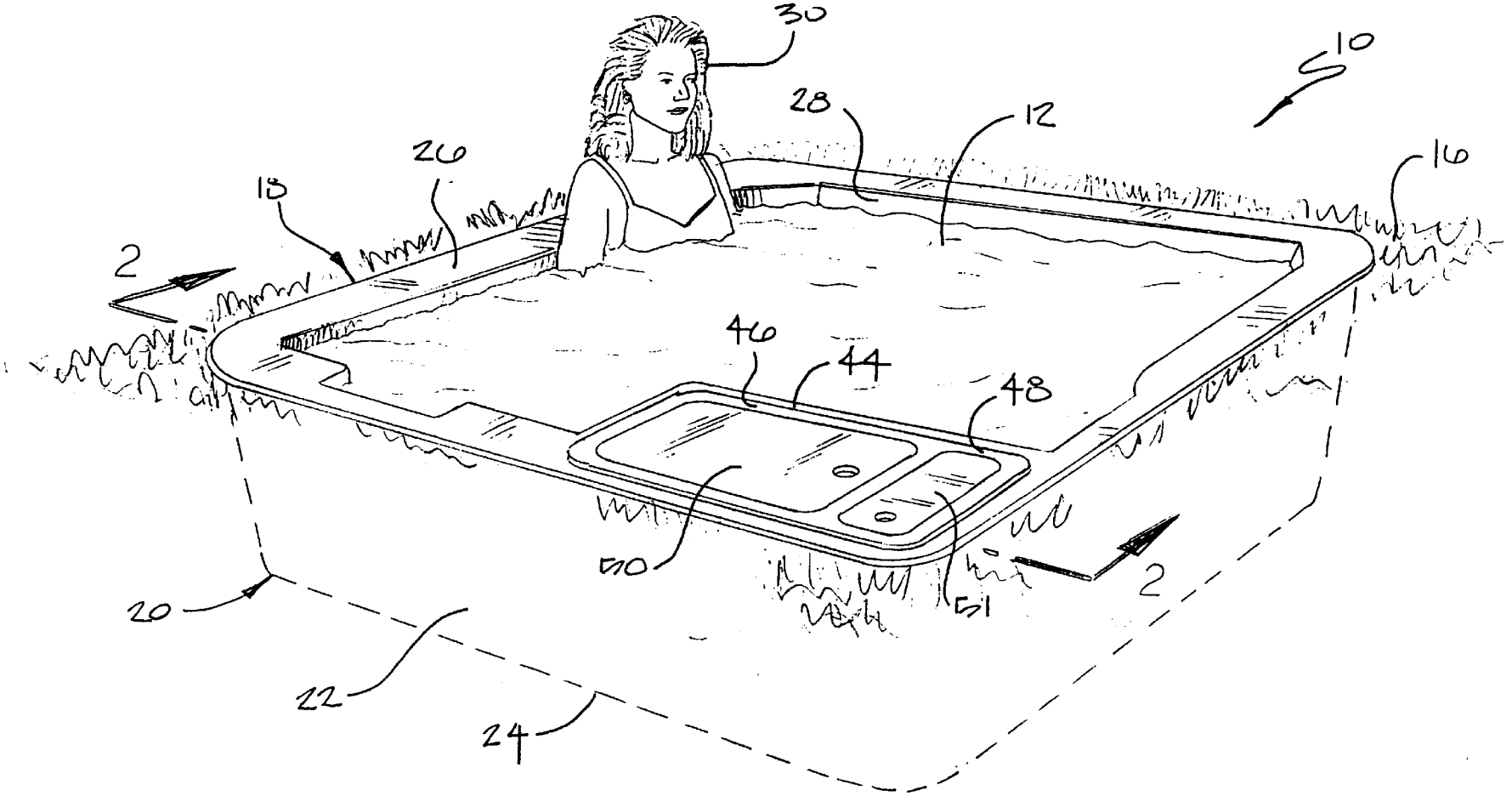
FIG. 1 is a perspective view of a portable spa embodying the present invention, showing the spa installed underground.

As shown in the accompanying drawings, the present invention is embodied in a spa, indicated generally by the reference numeral 10, for use in heating and circulating water 12 in the traditional manner. The spa 10 is capable of either above-ground installation, in which a raised deck 14 may be constructed around the spa, or direct in ground installation, in which the spa is installed in the ground 16 with the earth directly in contact with the side of the spa. In either case, access to the equipment required for service of the spa 10 is convenient and not hindered in any way by the manner of installation.

FIG. 1 shows the spa 10 installed directly in the ground 16. However, whether the spa 10 is installed in the ground 16, as in FIG. 1, or above the ground, as in FIG. 4, the basic structure of the spa is still the same. It is defined by a shell 18, which may be constructed of fiberglass, acrylic, high-impact thermoplastic materials, or any other suitable lightweight, high-strength material not easily susceptible to damage from water or sunlight. The shell 18 may be molded in a single unit, but more commonly it is a combination of several pieces joined together by adhesives or fasteners or by similar methods known in the art.

In one embodiment, the shell 18 comprises an outer wall 20 that defines the outer shape of the spa 10 and functions as a housing to enclose all of the remaining elements of the spa. In particular, the outer wall 20 comprises a vertical side wall 22 and a horizontal bottom wall 24. A horizontal coping 26 along the upper surface of the spa 10 provides a smooth transition from the vertical side wall 22 to an internal water reservoir 28 designed to hold a quantity of water 12 and at least one person 30.

Figure 2:
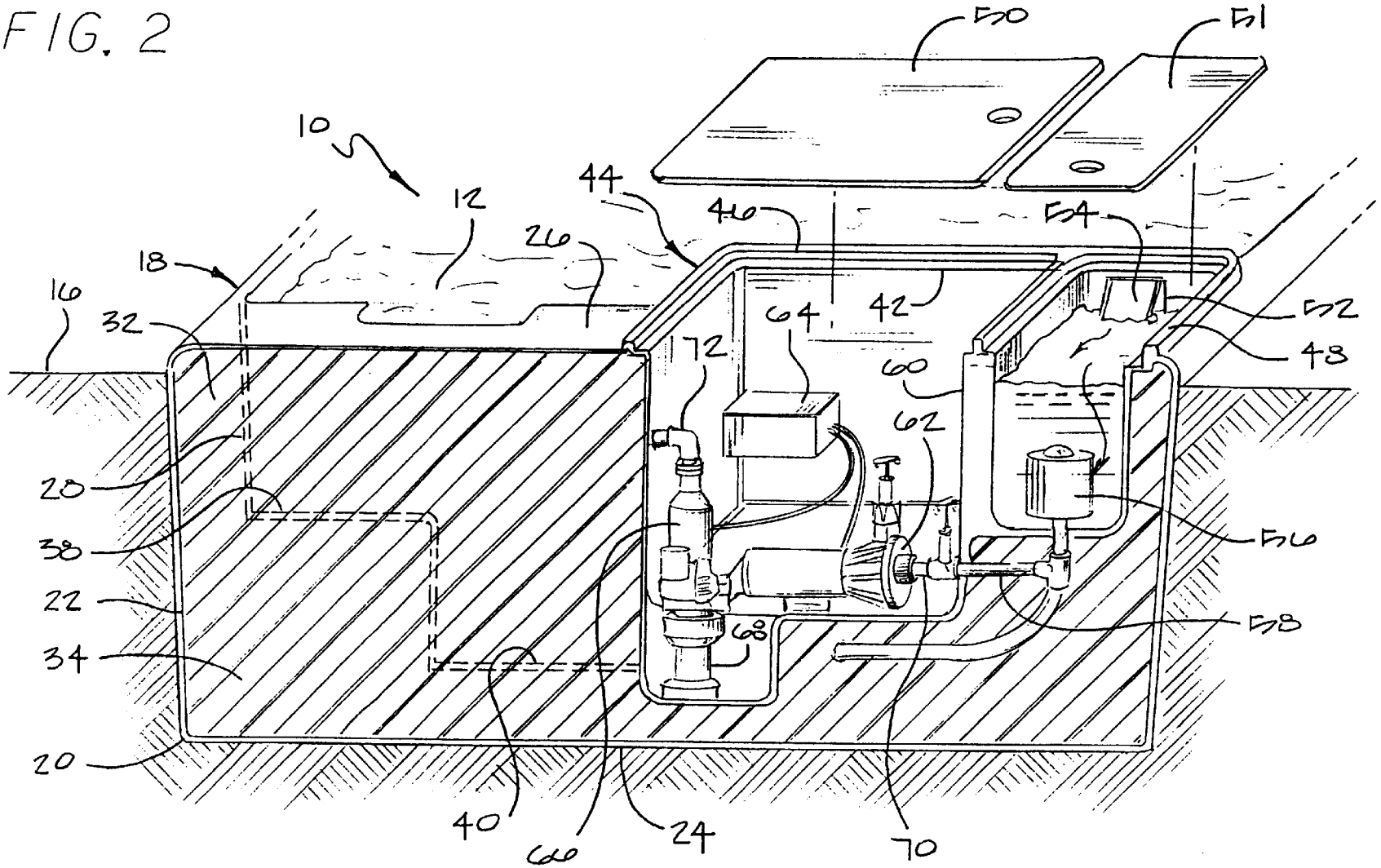
FIG. 2 is another perspective view of the spa, with a cross-section taken along the line 2—2 of FIG. 1, showing an equipment access door removed to permit access to the spa's technical equipment.

As shown in FIG. 2, a space 32 is provided between the outer wall 20 and the reservoir 28. This space 32 is preferably filled with a stiff insulating material 34, such as a dense Styrofoam or the like. The insulating material 34 increases the structural integrity of the spa 10, as well as its insulating qualities.

Figure 3:
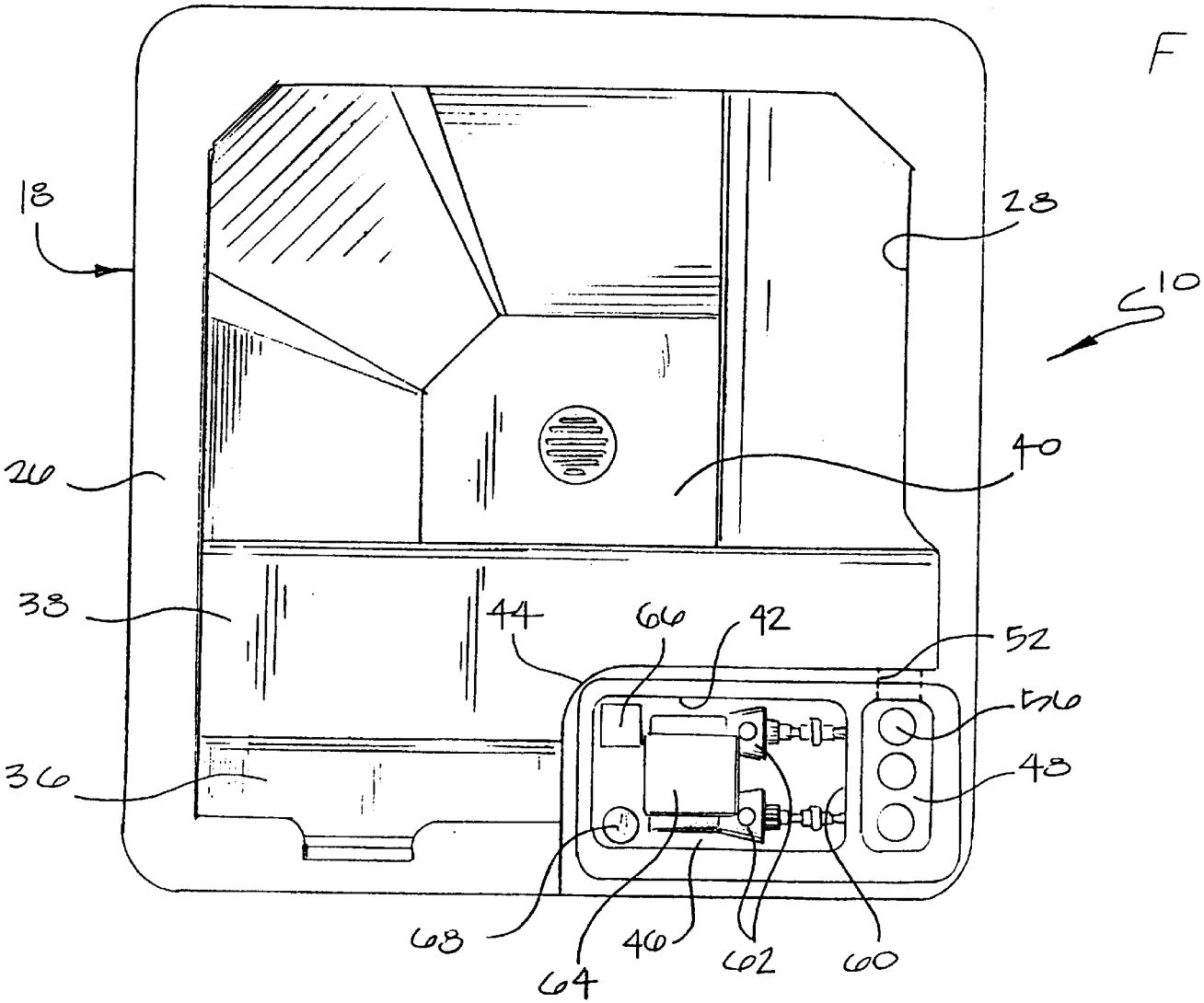
FIG. 3 is a top plan view of the spa.

With reference to FIGS. 2–3, a step 36 is included in the reservoir 28 for the user's ease and safety while entering the spa 10, and bench seats 38 are included for the user to sit or lounge in the water 12. A foot well 40 is also typically included in the center of the spa 10. Multiple hydro-jets (not shown) located around the perimeter of the reservoir 28 provide powerful streams of heated water that vigorously circulate the water 12 in the reservoir. It will be understood that the arrangement of the step 36, seats 38, foot well 40 (and hydro-jets) illustrated in the drawings is but one possible configuration, and many other arrangements could be used. In addition, in cases where the spa 10 is installed above the ground 16, an optional drainage line (not shown) originating at the lowest point of the reservoir 28 and terminating outside of the shell 18 may be included to assist in draining of the reservoir.

It will be noted that the coping 26 is considerably wider at one side of the spa 10 than any other. The coping 26 is enlarged in this area to provide an opening 42 leading to an equipment bay 44. The equipment bay 44 has two sections comprising an equipment compartment 46 and filtration compartment 48, both of which are located between the outer wall 20 and the internal reservoir 28. Preferably, the equipment compartment 46 and the filtration compartment 48 are in close proximity such that a single cover may be used to cover both. However, it is not a necessary requirement of this invention that the filtration compartment 48 and the equipment compartment 46 be located next to each other or that they share a common cover. Thus, a cover 50 for the equipment compartment 46 and a cover 51 for the filtration compartment 48 are shown. For convenience, both of these covers will be referred to as the cover 50.

With particular reference to FIG. 2, the filtration compartment 48 includes a skimmer 52 that provides a water flow path from the reservoir 28 to the filtration compartment 48. Thus, the water level in the filtration compartment 48 is maintained essentially at the same level as that in the reservoir 28. Preferably, the lower edge of the skimmer 52 is just below the water level so that only water from the uppermost surface of the reservoir 28 can enter the filtration compartment 48. The skimmer 52 also preferably includes an inwardly hinged skimmer door 54 or the like that allows water and floating debris from the upper surface of the reservoir 28 to enter filtration compartment 48. In the event that a wave or backflow causes water from the filtration compartment 48 to flow back into the reservoir 28, the skimmer door 54 will be forced to close. Thus, floating debris that enters the filtration compartment 48 will remain trapped therein until the user removes it during a periodic cleaning. A filter cartridge 56 located near the bottom of the filtration compartment 48 serves to filter impurities in the water before it travels from the filtration compartment 48 through a pipe 58 and on to the equipment compartment 46. The filter cartridges 56 are removable so that they can be periodically cleaned or replaced.

Unlike the filtration compartment 48, the equipment compartment 46 is not flooded with water 12. It is isolated from the filtration compartment 48 and the reservoir 28 by a vertical wall 60. The equipment compartment 46 houses a conventional water pump 62 (or pumps as shown in FIG. 3), such as a motor-driven impeller-type water pump. It also houses a conventional water heater 66 for heating the water 12 and maintaining a desired water temperature within the reservoir 28. A control box 64 houses the necessary controls for controlling operation of the water pumps 62, the water heater 66 and any other necessary equipment. A sump pump 68 is located in the lower-most portion of the equipment compartment 46 and serves to remove any excess water that might leak or be splashed into the compartment 46 or, when installed in-ground, any water resulting from fluctuation in water table levels. Power to operate the water pump 62 and the water heater 66 is supplied from an external electrical source (not shown) through a conventional hookup that may be located just below the edge of the coping 26.

The water pump 62 draws water from the reservoir 28 into the filtration compartment 48 and into the water heater 66 through an intake pipe 70. After passing through the heater 66, the water 12 is returned to the reservoir 28 by an output pipe 72 that distributes the heated water to the one or more hydro-jets located in various positions around the sides of the reservoir 28. The intake and output pipes 70 and 72 are preferably constructed of polyvinylchloride, but could also be made of other lightweight, noncorrosive materials. If it is desired to create a low-maintenance water treatment in the reservoir 28, a feature traditionally associated with spas of this type, the output pipe 72 may also include an ozone generator (not shown) that mixes ozone gas with the water flow before it enters the spa 10.

Figure 4:
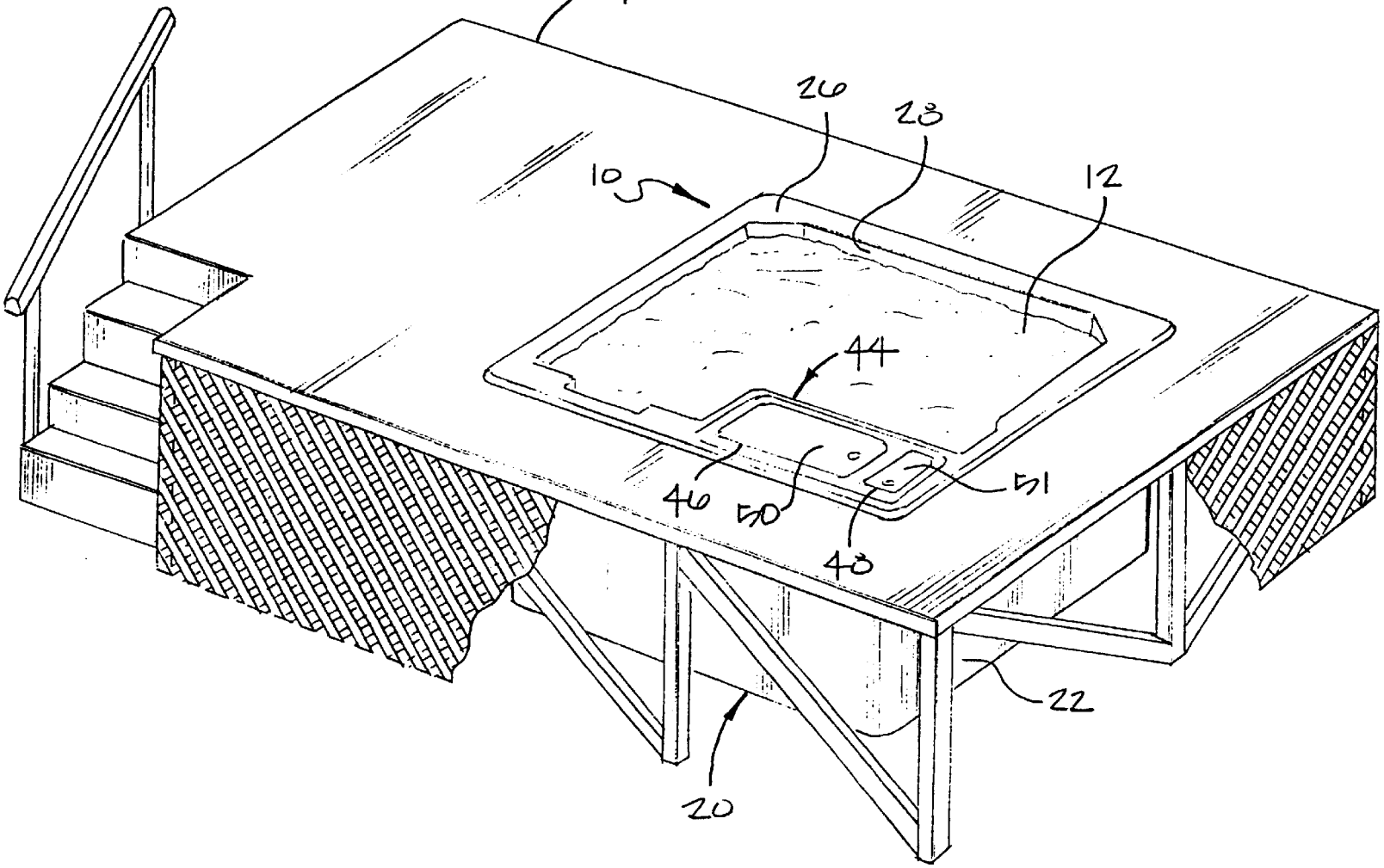
FIG. 4 is a perspective view of the spa installed above the ground with a raised deck surrounding the spa.

In accordance with the invention, the spa 10 may be installed above ground level, in the manner of a portable spa or, alternatively, it may be installed below ground level, in the manner of a permanently installed in-ground spa. If above-ground installation is desired, as shown in FIG. 4, one simply needs to place the spa 10 on a firm and level area (such as on a concrete pad or hard-packed earth), fill the reservoir 28 with water 12, and connect the power source. Since the side walls 22 of the spa are typically several feet high, an elevated deck 14 may also be built around the spa 10 to improve accessibility and appearance. Many variations of decks will serve this purpose.

Importantly, the elevated deck 14 does not require an equipment access door, either in the side or on the top of the deck, in order to gain access to the equipment bay 44. This is because all of the equipment in the equipment compartment 46 and the filtration compartment 48 can be conveniently reached by removing the cover 50 at the top of the spa 10. Hence, unsightly and potentially unsafe access doors in the deck 14 are avoided, as is the extra expense to make them. Moreover, the ease with which the equipment bay 44 can be reached is substantially enhanced. This is no need to crawl under the deck 14 through a side access door, or down through an access door in the top of the deck.

When the spa 10 is to be installed below ground level, as shown in FIGS. 1–2, a hole just slightly larger than the spa must be excavated. Once the spa 10 is placed in the hole, which may be as deep as the edge of the coping 26, some of the earth 16 that was excavated may be replaced directly around the walls of the spa, thus locking the spa into place. The reservoir 28 can then be filled with water 12 and the power source can be connected.

Importantly, no retaining wall or other type of barrier needs to be installed to keep the earth 16 away from the side walls 22 of the spa 10. Further, since the spa 10 is a self-contained unit having all of the necessary equipment to operate the spa, there is no need for additional excavation for plumbing, such as output pipes or hydro-jets. Again, only the power source needs to be connected, and since it is located just below the edge of the coping 26, it also does not require additional excavation. Thus, the spa 10 may be easily installed in areas where space is limited, and it may be installed in virtually any orientation desired by the user.

Furthermore, even though the entire side wall 22 of the spa 10 is buried underground, access to the equipment bay 44 is easily and conveniently accomplished through the top access cover 50 in the coping 26. Consequently, there is no need to build a retaining wall or the like around the spa 10 before it is placed in the hole. However, if the appearance of an in-ground spa is desired, and the user wishes to keep the option to move the spa 10 in the future, such a conventional retaining wall could be built. Advantageously, since the equipment bay 44 is accessible at the tope of the spa 10, only a small clearance is necessary between the spa side wall 22 and the retaining wall.

When the spa 10 is installed above-ground level, there will be some lateral forces against the walls comprising the reservoir 28 and the outer wall 20 of the shell 18. For example, the weight of the water 12 in the reservoir 28 creates an outward lateral pressure against the reservoir walls and contributes to the overall weight of the spa 10 and thus the forces exerted on the side wall 22 supporting the spa.

Even more significant, however, is the lateral pressure against the outer wall 20 caused by the earth 16 when the spa 10 is installed directly in the ground. If the reservoir 28 is empty for a significant time, this lateral inward pressure could cause substantial damage or buckling of the walls without a counteracting support system. Accordingly, the present invention provides a reinforcing means to prevent this damage.

FIG. 5 illustrates one embodiment of a reinforcing means comprising an internal support framework 74 which provides the necessary structural support to enable the side wall 22 of the spa 10 to resist the subjacent lateral forces of the earth 16 resulting from in-ground installation. The support framework 74 comprises a plurality of supports such as pressure treated wood. Other suitable supports, such as supports made from rigid plastic material, also can be used. The support framework 74 is located in the space 32 between the reservoir 28 and the outer wall 20 and comprises bottom horizontal supports 76, top horizontal supports 78 and vertical supports 80 extending between and connecting the top supports 78 to the bottom supports 78. Triangulation of the vertical supports 80 is accomplished by braces 82 having one end connected either to a vertical support 80 or a top horizontal support 78 and having another end connected to a corresponding horizontal bottom support 76.

A dense foam or similar lightweight, high-strength material 34, discussed above, may also be used as a filler between the outer wall 20 and the reservoir 28 to increase the structural integrity as well as the insulation capacity of the spa 10. In this regard, it is contemplated that an appropriate filler 34 with the requisite structural strength and other characteristics could be used alone to support the spa 10, without requiring the support framework 74 discussed above.

An alternative embodiment of the invention is illustrated in FIG. 6. In this embodiment, the equipment compartment 46 and the filtration compartment 48 are accessible from the side of the shell 18 through a side access door 84. A side shield 86 isolates and protects the side access door 84 from the surrounding earth 16 for an in ground installation. However, the excavated ground otherwise completely surrounds and abuts against the side wall 22 of the spa 10, as in the in-ground installation discussed above.

From the foregoing, it will be appreciated that the present invention provides a universal self-contained spa 10 that can be installed either above ground or below ground level, while still providing a means to access the equipment necessary to service the spa. Access to the equipment is both convenient and safe, and the overall appearance of the spa 10 and its surrounding environment is as aesthetically pleasing as possible. The resulting spa is extremely versatile, as it may be portable or permanently installed at the option of the owner.

While a particular form of the invention has been illustrated and described, it will be apparent that various modifications can be made without departing from the spirit and scope of the invention. Accordingly, it is not intended that the invention be limited, except as by the appended claims.

We claim:

1. A pre-fabricated self-contained in-ground spa, comprising:

(a) a reservoir for holding water and substantially the entire body of at least one adult person;

(b) an outer wall spaced outwardly from the reservoir;

(c) an equipment bay located in and accessible from an opening at the top surface of the spa between the outer wall and the reservoir that contains all of the equipment for operating the spa, including a pump, a heater element a filter and control equipment, so that access to external equipment outside the outer wall is unnecessary other than a source of electricity or gas, wherein at least a portion of the equipment bay and the equipment therein extends below the water level in the spa;

(d) a sump pump at a lower end of the equipment bay; and (e) a cover that covers the opening in the top surface of the spa, wherein the cover can be opened to permit access to the equipment in the equipment bay free of any obstructions around the vertical side wall of the spa.

2. The spa of claim 1, further comprising reinforcing materials located between the outer wall and the reservoir for supporting the outer wall against deformation from external forces, whereby the spa can be installed below ground level and can withstand external forces from excavated ground applying pressure against the outer wall.

3. The spa of claim 2, wherein the reinforcing material comprises a plurality of internal support elements that resist lateral external forces against the outer wall.

4. The spa of claim 3, wherein the reinforcing material further comprises a dense foam material or other suitable filler.

5. The spa of claim 1, wherein the reinforcing material comprises a dense foam material or other suitable filler.

6. The spa of claim 3, wherein the internal support elements comprise elongated rigid supports interposed between the outer wall, the reservoir, and a bottom wall supporting the spa.

7. The spa of claim 1, wherein the reinforcing material comprises a framework substantially supporting the outer wall, including a plurality of horizontal bottom support elements, a plurality of horizontal top support elements, a plurality of vertical support elements connecting the bottom support elements to the top support elements, and a plurality of bracing elements connected at an angle between the vertical support elements and the horizontal bottom elements.

8. The spa of claim 7, wherein the framework is comprised of pressure treated wood.

* * * * *